US005640722A

United States Patent [19]

Bui

[11] Patent Number: 5,640,722

[45] Date of Patent: Jun. 24, 1997

[54] PLUNGER AND BRUSH DISPENSING TOILET COVER

[76] Inventor: Lam Thanh Bui, 16121 Parkside La. #J2, Huntington, Calif. 92647

[21] Appl. No.: 555,069

[22] Filed: Nov. 8, 1995

[51] Int. Cl.[6] ..... E03D 1/00

[52] U.S. Cl. ..... 4/353; 4/661

[58] Field of Search ..... 4/353, 661, 255.11, 4/410, 363, 364

[56] References Cited

U.S. PATENT DOCUMENTS

| | | | |
|---|---|---|---|
| 2,099,932 | 11/1937 | Isaacson | 4/353 |
| 2,434,399 | 1/1948 | Duckenfield | 4/364 |
| 2,701,702 | 2/1955 | Diederich | 4/353 |
| 3,045,249 | 7/1962 | Stuart, Jr. | 4/410 |
| 3,314,080 | 4/1967 | Shilling, Jr. | 4/353 |
| 4,918,769 | 4/1990 | Gandini | 4/363 |
| 5,099,527 | 3/1992 | Roose | 4/255.11 |

*Primary Examiner*—David J. Walczak

[57] ABSTRACT

A plunger and brush dispensing toilet cover including a generally planar cover adapted to retrofit a reservoir of a conventional toilet. A circular cutout is formed adjacent a first end edge. The circular cutout has an associated periphery with a diameter greater than the diameter of a plunger for allowing the access thereof. A rectangular cutout is formed adjacent a second end edge. The rectangular cutout has an associated periphery with a length and width greater than the length and width of a toilet brush for allowing the access thereof. Also included is a circular template releasably coupled to the plunger. The diameter of the plunger template is greater than the diameter of the circular cutout. A rectangular template is releasably coupled to the toilet brush and has a length and width greater than the length and width of the rectangular cutout. Both templates are adapted to rest about the periphery of the cutouts of the cover whereby the plunger and brush depend from the cover within the reservoir.

1 Claim, 3 Drawing Sheets

PLUNGER AND BRUSH DISPENSING TOILET COVER

BACKGROUND OF THE INVENTION

1. Field of the Invention

The present invention relates to a plunger and brush dispensing toilet cover and more particularly pertains to containing a plunger and toilet brush within a toilet reservoir and further dispensing them therefrom.

2. Description of the Prior Art

The use of bathroom cleaning tool assemblies is known in the prior art. More specifically, bathroom cleaning tool assemblies heretofore devised and utilized for the purpose of containing bathroom cleaning tools are known to consist basically of familiar, expected and obvious structural configurations, notwithstanding the myriad of designs encompassed by the crowded prior art which have been developed for the fulfillment of countless objectives and requirements.

By way of example, the prior art discloses in U.S. Pat. No. 4,008,933 to Wanek a bathroom accessory in the form of a decorative piece of furniture adapted to provide a plurality of separate storage compartments. U.S. Pat. No. 4,033,650 to Alissandratos discloses a sanitary brush assembly in the form of a wall mounted enclosure device for a toilet cleaning brush. U.S. Pat. No. 3,988,788 to Aue discloses a device for cleaning a toilet comprising a spray means secured to a toilet seat lid for dispersion of a cleaning fluid therefrom. U.S. Pat. No. 4,183,105 to Womack; U.S. Pat. No. 5,308,405 to McElroy; U.S. Pat. No. 4,248,254 to Trimble are provided as being of general interest.

In this respect, the plunger and brush dispensing toilet cover according to the present invention substantially departs from the conventional concepts and designs of the prior art, and in so doing provides an apparatus primarily developed for the purpose of containing a plunger and toilet brush within a toilet reservoir and further dispensing them therefrom.

Therefore, it can be appreciated that there exists a continuing need for a new and improved plunger and brush dispensing toilet cover which can be used for containing a plunger and toilet brush within a toilet reservoir and further dispensing them therefrom. In this regard, the present invention substantially fulfills this need.

SUMMARY OF THE INVENTION

In view of the foregoing disadvantages inherent in the known types of bathroom cleaning tool assemblies now present in the prior art, the present invention provides an improved plunger and brush dispensing toilet cover. As such, the general purpose of the present invention, which will be described subsequently in greater detail, is to provide a new and improved plunger and brush dispensing toilet cover apparatus and method which has all the advantages of the prior art and none of the disadvantages.

To attain this, the present invention essentially comprises a generally planar cover with a rectangular configuration. The cover has a top surface, a bottom surface, and a pair of elongated side edges and short end edges defining a periphery. A flange is formed about the periphery and depends downwardly therefrom. A circular cutout is formed adjacent a first end edge. The circular cutout has an associated periphery with a diameter greater than the diameter of a suction cup of a plunger for allowing the access thereof. A rectangular cutout is formed adjacent a second end edge.

The rectangular cutout has an associated periphery with a length and width greater than the length and width of a bristle end of a toilet brush for allowing the access thereof. The planar cover is adapted to retrofit a reservoir of any conventional toilet.

Also included is a plunger template formed of a plastic material with a circular configuration. The plunger template has a diameter greater than the diameter of the circular cutout of the cover. An aperture is centrally formed therein for releasably receiving a handle of the plunger. The plunger template is adapted to rest about the periphery of the circular cutout whereby the suction cup of the plunger depends from the cover within the reservoir.

Finally, a toilet brush template is formed of a plastic material with a rectangular configuration. The toilet brush template has a length and width greater than the length and width of the rectangular cutout of the cover. An aperture is centrally formed therein for releasably receiving the handle of the toilet brush. The toilet brush template is adapted to rest about the periphery of the rectangular cutout whereby the bristle end of the toilet brush depends from the cover within the reservoir.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved plunger and brush dispensing toilet cover which has all the advantages of the prior art bathroom cleaning tool assemblies and none of the disadvantages.

It is another object of the present invention to provide a new and improved plunger and brush dispensing toilet cover which may be easily and efficiently manufactured and marketed.

It is a further object of the present invention to provide a new and improved plunger and brush dispensing toilet cover which is of a durable and reliable construction.

An even further object of the present invention is to provide a new and improved plunger and brush dispensing toilet cover which is susceptible of a low cost of manufacture with regard to both materials and labor, and which accordingly is then susceptible of low prices of sale to the consuming public, thereby making such plunger and brush dispensing toilet covers economically available to the buying public.

Still yet another object of the present invention is to provide a new and improved Plunger and brush dispensing toilet cover which provides in the apparatuses and methods of the prior art some of the advantages thereof, while simultaneously overcoming some of the disadvantages normally associated therewith.

Still another object of the present invention is to contain a plunger and toilet brush within a toilet reservoir and further dispense them therefrom.

Lastly, it is an object of the present invention to provide a new and improved plunger and brush dispensing toilet cover including a generally planar cover adapted to retrofit a reservoir of a conventional toilet. A circular cutout is formed adjacent a first end edge. The circular cutout has an associated periphery with a diameter greater than the diameter of a plunger for allowing the access thereof. A rectangular cutout is formed adjacent a second end edge. The rectangular cutout has an associated periphery with a length and width greater than the length and width of a toilet brush for allowing the access thereof. Also included is a circular template releasably coupled to the plunger. The diameter of the plunger template is greater than the diameter of the circular cutout. A rectangular template is releasably coupled to the toilet brush and has a length and width greater than the length and width of the rectangular cutout. Both templates are adapted to rest about the periphery of the cutouts of the cover whereby the plunger and brush depend from the cover within the reservoir.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
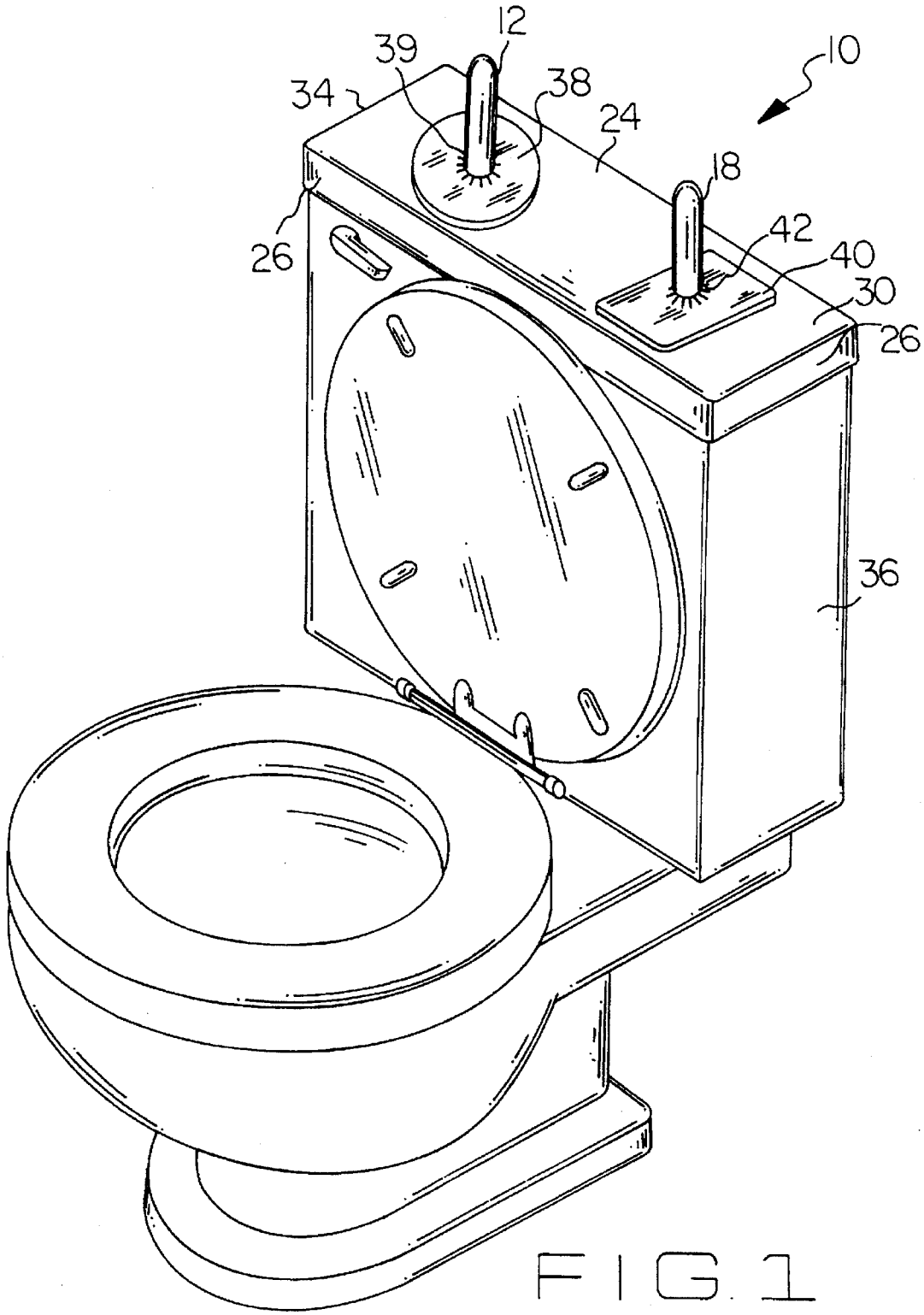
FIG. 1 is a perspective illustration of the preferred embodiment of the plunger and brush dispensing toilet cover constructed in accordance with the principles of the present invention.
Figure 2:
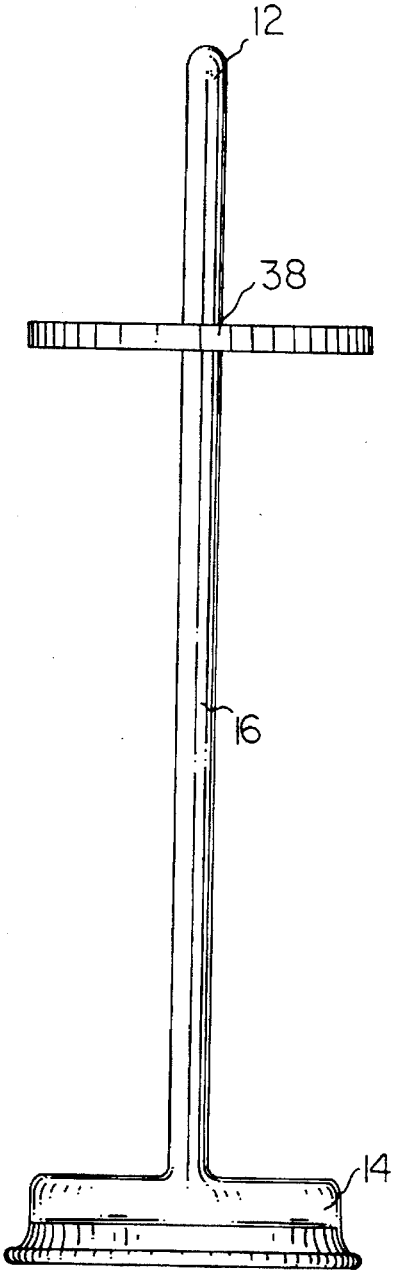
FIG. 2 is a plan side view of the plunger and associated circular template employed in the present invention.
Figure 3:
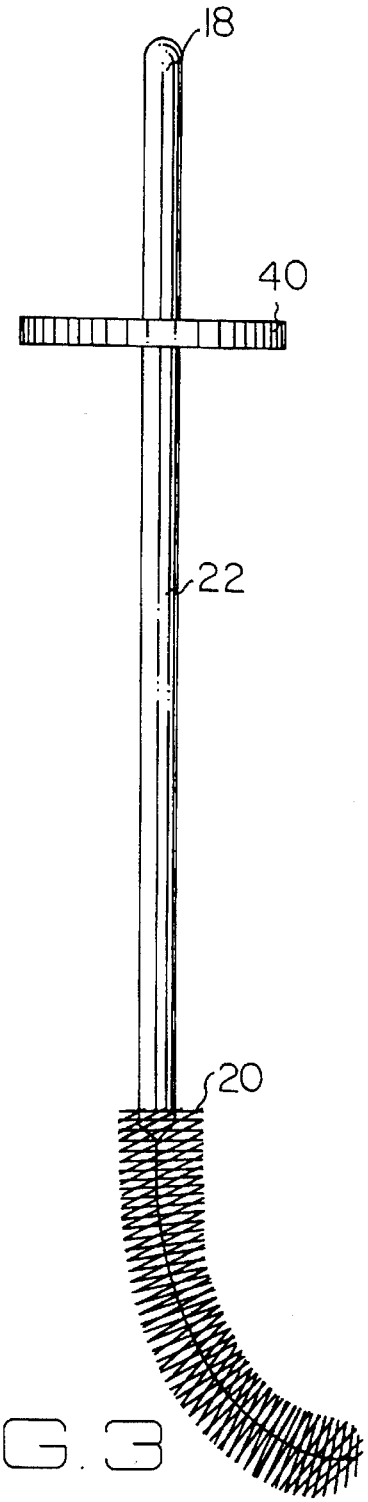
FIG. 3 is a plan side view of the toilet brush and associated rectangular template employed in the present invention.
Figure 4:
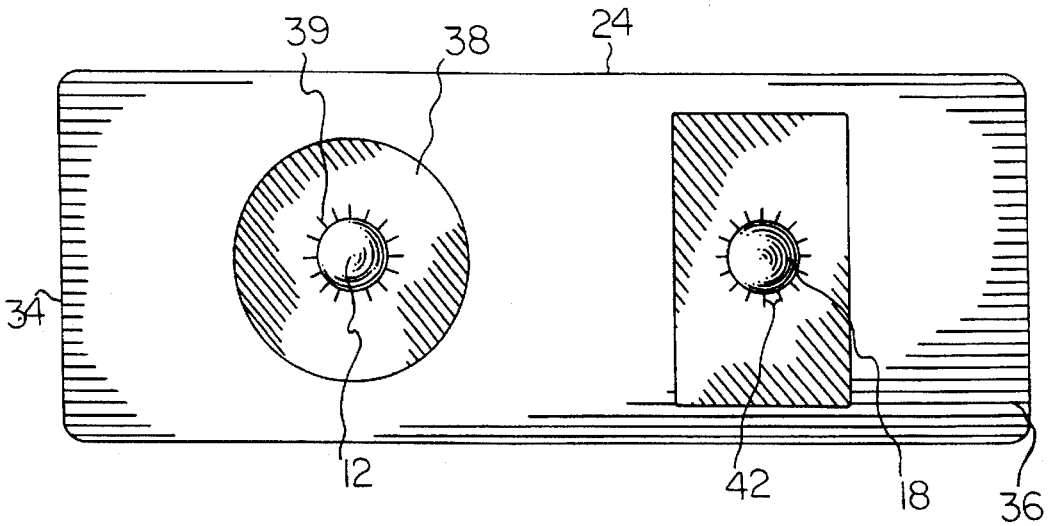
FIG. 4 is a plan top view of the present invention.
Figure 5:
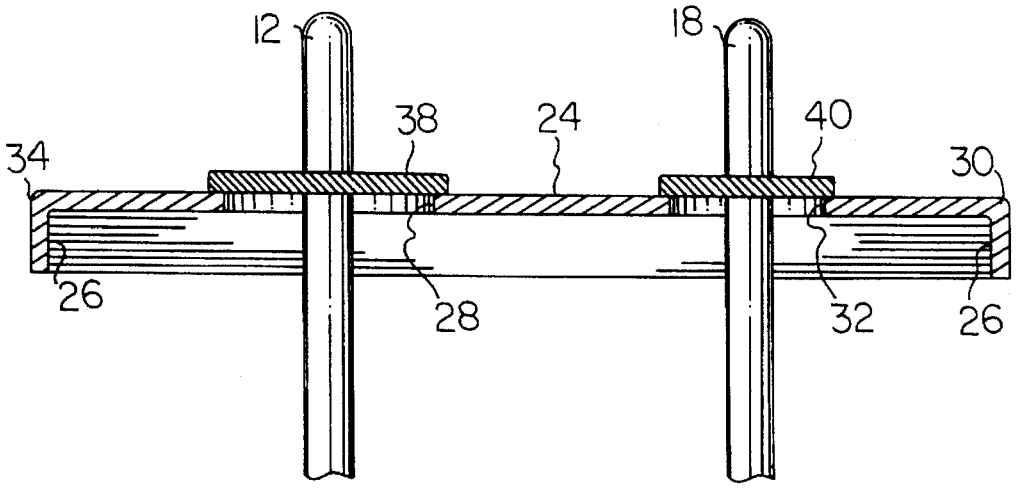
FIG. 5 is a lengthwise cross-sectional view of the present invention.

With reference now to the drawings, and in particular to FIG. 1 thereof, a new and improved plunger and brush dispensing toilet cover embodying the principles and concepts of the present invention and generally designated by the reference numeral 10 will be described.

The present invention, the new and improved plunger and brush dispensing toilet cover, is comprised of a plurality of components. Such components in their broadest context include a plunger, toilet brush, cover, and a pair of templates. Such components are individually configured and correlated with respect to each other so as to attain the desired objective.

More specifically, it will be noted that the system 10 of the present invention comprises a conventional plunger 12. The plunger includes an elastomeric suction cup 14 with an elongated cylindrical handle 16 coupled thereto and extending upwardly therefrom. The suction cup has an associated diameter.

Also included is a conventional toilet brush 18. The toilet brush includes a bristle end 20 with an elongated handle 22 coupled thereto and extending upwardly therefrom. The bristle end has an associated length and width.

A generally planar cover 24 is formed of a plastic material with a rectangular configuration. The cover has a top surface, a bottom surface, and a pair of elongated side edges and short end edges defining a periphery. The length of the elongated side edges is approximately 18 inches and the length of the short end edges is approximately 8 inches. A flange 26 is formed about the periphery and depends downwardly therefrom. A circular cutout 28 is formed adjacent a first end edge 34. The circular cutout has an associated periphery with a diameter greater than the diameter of the suction cup for allowing the plunger to pass therethrough. A rectangular cutout 32 is formed adjacent a second end edge 30. The rectangular cutout has an associated periphery with a length and width greater than the length and width of the bristle end for allowing the toilet brush to pass therethrough. The planar cover is adapted to retrofit a reservoir 36 of a conventional toilet.

A plunger template 38 is formed of a plastic material with a circular configuration. The plunger template has a diameter greater than the diameter of the circular cutout of the cover. An aperture is centrally formed therein for releasably receiving the handle of the plunger. Small slits 39 extend radially outward from the aperture for securing the template about the handle. The plunger template is adapted to rest about the periphery of the circular cutout whereby the suction cup of the plunger depends from the cover within the reservoir.

Finally, a toilet brush template 40 is formed of a plastic material with a rectangular configuration. The toilet brush template has a length and width greater than the length and width of the rectangular cutout of the cover. An aperture is centrally formed therein for releasably receiving the handle of the toilet brush. Small slits 42 extend radially outward from the aperture for securing the template about the handle. The toilet brush template is adapted to rest about the periphery of the rectangular cutout whereby the bristle end of the toilet brush depends from the cover within the reservoir.

The present invention provides a device for both containing and dispensing any number of bathroom cleaning devices by utilizing a standard toilet reservoir. Such a device aids in keeping a bathroom neat, clean and organized. The device may be manufactured in a plurality of different colors. Hotels, commercial establishments or any household would benefit from the features provided therewith.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A new and improved plunger and brush dispensing toilet cover comprising, in combination:

a conventional plunger including an elastomeric suction cup with an elongated cylindrical handle coupled thereto and extending upwardly therefrom, the suction cup having an associated diameter;

a conventional toilet brush including a bristle end with an elongated handle coupled thereto and extending upwardly therefrom, the bristle end having an associated length and width;

a generally planar cover formed of a plastic material with a rectangular configuration having a top surface, a bottom surface, and a pair of elongated side edges and a pair of short end edges defining a periphery, the planar cover having a flange formed about the periphery and depending downwardly therefrom; a circular cutout formed adjacent a first end edge, the circular cutout having an associated periphery with a diameter greater than the diameter of the suction cup for allowing the plunger to pass therethrough; and a rectangular cutout formed adjacent a second end edge, the rectangular cutout having an associated periphery with a length and width greater than the length and width of the bristle end for allowing the toilet brush to pass therethrough; the planar cover adapted to retrofit a reservoir of a conventional toilet;

a plunger template formed of a plastic material with a circular configuration having a diameter greater than the diameter of the circular cutout of the cover, the plunger template having an aperture centrally formed therein for releasably receiving the handle of the plunger, the plunger template adapted to rest about the periphery of the circular cutout whereby the suction cup of the plunger depends from the cover within the reservoir; and a toilet brush template formed of a plastic material with a rectangular configuration having a length and width greater than the length and width of the rectangular cutout of the planar cover, the toilet brush template having an aperture centrally formed therein for releasably receiving the handle of the toilet brush, the toilet brush template adapted to rest about the periphery of the rectangular cutout whereby the bristle end of the toilet brush depends from the cover within the reservoir.

* * * * *